US010145032B2

(12) United States Patent
Dilo

(10) Patent No.: US 10,145,032 B2
(45) Date of Patent: Dec. 4, 2018

(54) CROSS LAPPER

(71) Applicant: Oskar Dilo Maschinenfabrik KG, Eberbach (DE)

(72) Inventor: Johann Philipp Dilo, Eberbach (DE)

(73) Assignee: Oskar Dilo Maschinenfabrik KG (DE)

( * ) Notice: Subject to any disclaimer, the term of this patent is extended or adjusted under 35 U.S.C. 154(b) by 613 days.

(21) Appl. No.: 14/887,571

(22) Filed: Oct. 20, 2015

(65) Prior Publication Data

US 2016/0115628 A1 Apr. 28, 2016

(30) Foreign Application Priority Data

Oct. 27, 2014 (EP) ..... 14190497
Sep. 30, 2015 (EP) ..... 15187645

(51) Int. Cl.
*D01G 25/00* (2006.01)

(52) U.S. Cl.
CPC ..... *D01G 25/00* (2013.01)

(58) Field of Classification Search
CPC ..... D01G 25/00
USPC ..... 19/163
See application file for complete search history.

(56) References Cited

U.S. PATENT DOCUMENTS 5,590,442 A * 1/1997 Hirschek ..... D01G 25/00 19/163
8,458,999 B2 * 6/2013 Dilo ..... D04H 1/74 57/296
8,495,799 B2 * 7/2013 Dilo ..... D04H 1/74 19/163
9,725,830 B2 * 8/2017 Dilo ..... B65G 15/00
2005/0193526 A1 * 9/2005 Leger ..... D01G 25/00 19/163
2012/0180264 A1 7/2012 Dilo
2012/0180265 A1 * 7/2012 Dilo ..... D01G 25/00 19/296
2017/0088358 A1 * 3/2017 Dilo ..... B65G 15/00

FOREIGN PATENT DOCUMENTS

DE 4217285 C1 1/1994
EP 2479321 A1 7/2012

* cited by examiner

*Primary Examiner* — Shaun R Hurley

(74) *Attorney, Agent, or Firm* — Jansson Munger McKinley & Kirby Ltd.

(57) ABSTRACT

The cross lapper for forming a nonwoven fabric from a fiber web includes in its infeed area a smooth cover belt or an array of linear elements spaced a certain distance apart and arranged parallel to each other to cover the fiber web being carried along on the upper run of a first web conveyor belt. The first end section of the cover belt or of the array of linear elements is connected to the upper carriage of the cross lapper. During operation of the cross lapper the fiber web moves along the bottom surface of a cover section of the cover belt or of the array of linear elements. The cross lapper comprises a compensating mechanism to compensate for the changes in the length of the cover section which occur as the upper carriage moves transversely back and forth.

22 Claims, 2 Drawing Sheets

CROSS LAPPER

CROSS REFERENCE TO RELATED APPLICATIONS

This application claims priority based on European Patent Application No. EP 14 190 497.9, filed Oct. 27, 2014 and to EP patent Application No. EP 15 187 645.5, filed Sep. 30, 2015, the contents of which are incorporated by reference in their entireties.

FIELD

The present invention relates to cross lappers for forming nonwovens from fiber webs.

BACKGROUND

Cross lappers serve to lay multiple layers of a fiber web supplied by a carding machine uniformly on an output conveyor belt. The fiber web is usually sent through an upper carriage first and from there to a laying carriage, through the laying nip of which the fiber web is laid onto the output conveyor belt. To guide the fiber web through the cross lapper, at least two fiber web conveyor belts are used. The movements of the web conveyor belts, of the upper carriage, and of the laying carriage are controlled in coordination with each other.

In the area extending from the infeed area of the cross lapper to the upper carriage, it is advantageous for the fiber web not only to rest on the web conveyor belt but also to be sandwiched from above by a cover belt. The purpose of this is to prevent the fiber web from being blown about and thus to ensure the uniformity of the laid nonwoven. Structures of this type are known from DE 195 43 623 A1, EP 1 136 600 A1, and EP 1 870 499 B1, for example. The disadvantage of these cross lapper designs is the complexity with which the endless cover belt must be guided, which requires a large number of components and considerable mechanical effort.

EP 2 479 321 A1 discloses a simplified configuration of cross lapper, in which the cover belt is smooth and does not move along with the fiber web. Instead, it serves as a more-or-less stationary cover for the fiber web. To ensure that the cover belt covers the fiber web on the web conveyor belt for as long as possible, the cover belt runs from an attachment point in the infeed area of the cross lapper, through the upper carriage, to a second attachment point at the other end of the cross lapper.

The disadvantage of this configuration is that, when the cover belt slides through the upper carriage, high relative speeds are reached between the stationary cover belt and the upper carriage as it travels back and forth in the transverse direction. This results in severe stress on the cover belt and increased wear, especially in the area of the reversal point of the upper carriage.

SUMMARY

It is an object of the present invention to provide a cross lapper in which the supplied fiber web is guided securely and the forces acting on the cover are reduced.

According to an aspect of the invention, the cross lapper for forming a nonwoven from a fiber web comprises a transversely movable upper carriage, through which the fiber web is guided, and also a transversely movable laying carriage, through which the fiber web coming from the upper carriage is guided, and which serves to lay the fiber web on an output conveyor belt. The cross lapper also comprises at least two web conveyor belts for guiding the fiber web to the upper carriage and then to the laying carriage, wherein a first endless web conveyor belt, the upper run of which extends from the infeed area of the cross lapper to the upper carriage and serves as a support surface for the fiber web, is configured as a rough web conveyor belt and carries by friction the fiber web resting on it. Above the upper run of the first web conveyor belt, a cover section for covering the top surface of the fiber web resting on the upper run of the first web conveyor belt is arranged, wherein the cover section is configured as a section of the cover belt or as a section of an array of linear elements arranged a certain distance apart and parallel to each other. The cover belt or the linear elements are smooth, and the fiber web moves along the bottom surface of the cover section. The first end section of the cover belt or of the array of linear elements is connected to the upper carriage, and the cross lapper also comprises a compensating mechanism to compensate for the changes in the length of the cover section which occur as the upper carriage travels transversely back and forth.

This configuration reduces the wear on the cover belt or on the linear elements in a manner which is both structurally simple and low in cost, wherein in addition it is ensured that the fiber web is guided securely without being blown about.

The cross lapper preferably comprises a tension carriage, which is transversely movable back and forth in the direction opposite to that of the upper carriage. The tension carriage is a component of the compensating mechanism and is connected to the second end section of the cover belt or array of linear elements. As a result, the compensation for the change in length of the cover section which occurs as the upper carriage travels in the transverse direction can be achieved by an especially simple mechanism.

It is especially preferable for the cover belt or the array of linear elements to be deflected in the infeed area of the cross lapper and for at least the second end section of the cover belt or of the array of linear elements to be guided substantially parallel to the upper run of the first web conveyor belt up to an attachment point on the tension carriage and to be fastened to this attachment point. This embodiment is especially suitable for obtaining a compensating mechanism which is both compact and simple in design.

The attachment point is preferably formed on a rail, and it is also preferable for the tension carriage to be arranged under the upper run of the first web conveyor belt and for the rail to be arranged between two tension brackets, which are attached to the sides of the tension carriage and project upward from it beyond the upper run of the first web conveyor belt. With a concrete implementation of this type, the same tension carriage can be used both to compensate for the changes in length of the cover section and to keep the length of the loop of the first web conveyor belt constant as the upper carriage moves transversely back and forth. This represents a low-cost solution which leads to no additional cost for open-loop or closed-loop control, and the structural complexity of arrangement is significantly reduced.

So that the fiber web can be prevented as completely and effectively as possible from being blown about, it is also advantageous for at least one first fiber web guide means to be provided in a section between the attachment point of the first end section of the cover belt or of the array of linear elements in the upper carriage and the point where the fiber web is transferred to the second web conveyor belt. This guide means guides the fiber web in this section, wherein the fiber web is sandwiched between the at least one first fiber web guide means and the first web conveyor belt. It is especially preferable for the attachment point of the first end section of the cover belt or of the array of linear elements in the upper carriage to be a component of the first fiber web guide means. Sandwiched between the cover section or the first fiber web guide means on one side and the first web conveyor belt on the other side, the fiber web therefore is covered continuously, as a result of which it is possible to achieve very high line speeds.

In a preferred embodiment, at least one second fiber web guide means is provided in a section of the infeed area extending up to a point at which the fiber web is sandwiched between the first web conveyor belt and the cover section. This second guide means guides the fiber web in this section, wherein the fiber web is sandwiched between the at least one second fiber web guide means and the first web conveyor belt. As a result, it is possible to prevent the fiber web from being blown about in the infeed area as well as at high web infeed speeds.

The cover belt is preferably air-permeable, so that entrained air, for example, can escape from the fiber web.

In many cases it can also be advisable for the cover belt to be impermeable to air, so that it can be ensured that the fiber web is covered and guided by the cover belt in an especially secure manner.

So that the surface of the cover is as smooth and wear-resistant as possible, the cover belt is preferably made of a fabric carrier coated with either Teflon™ (polytetrafluoroethylene) or PVC (polyvinylchloride), both of which are well known in the art.

When an air-impermeable cover belt is present, it is especially advantageous for the first web conveyor belt to be air-permeable. In this way, the air being carried along by the fiber web can effectively escape in a downward direction and the fiber web is prevented from being blown about.

When an array of linear elements is used, the linear elements are preferably formed as cords, yarns, stranded wires, solid wires, or narrow belts.

BRIEF DESCRIPTION OF THE DRAWINGS

The drawings illustrate preferred embodiments including the above-noted characteristics and features of the device. The device will be readily understood from the descriptions and drawings. In the drawings.

DETAILED DESCRIPTION

Figure 1:
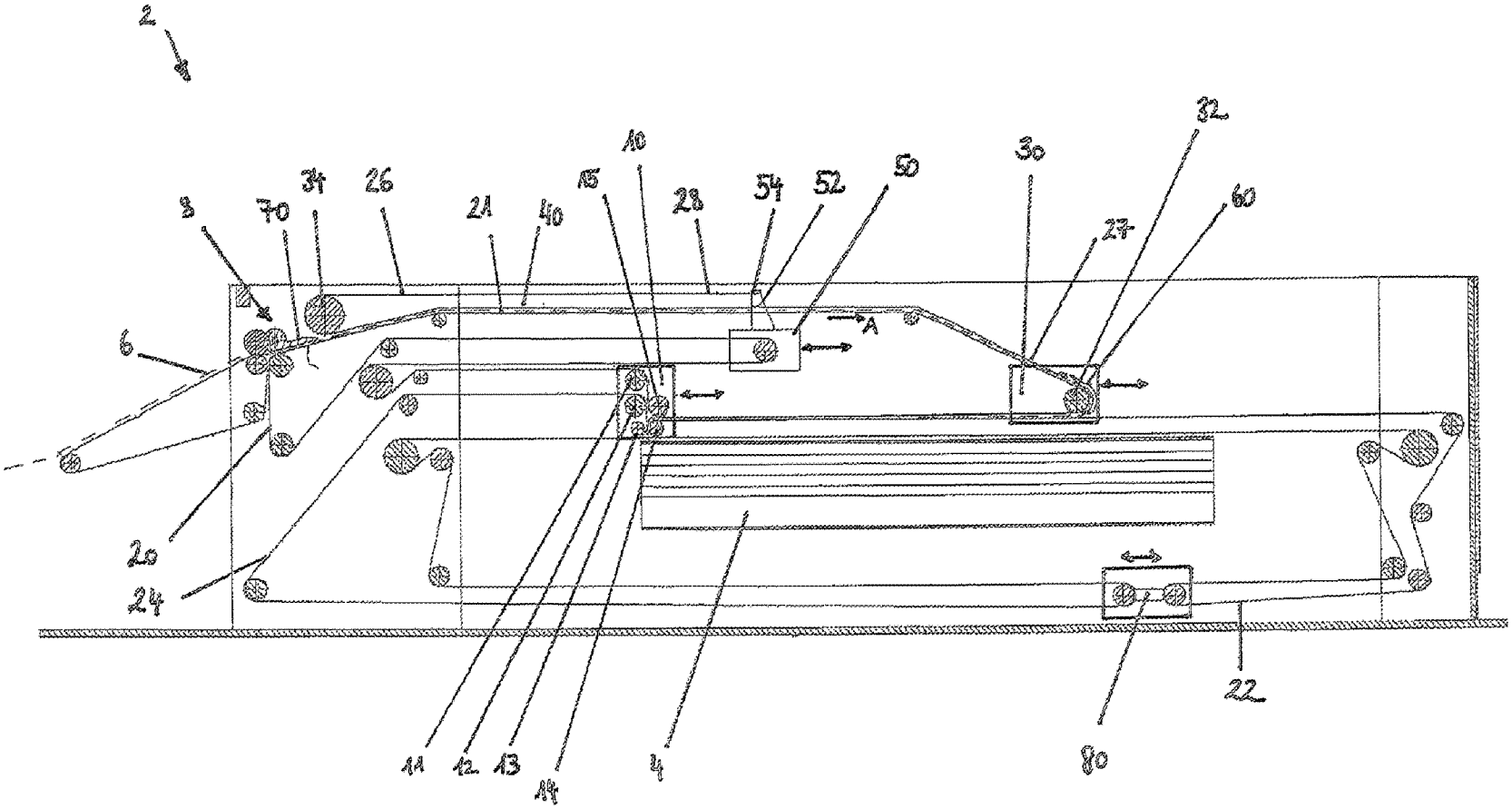
FIG. 1 shows a schematic cross-sectional view of one embodiment of a cross lapper according to the invention.

FIG. 1 is a schematic cross-sectional view of one embodiment of the invention. FIG. 1 shows a cross lapper 2 with an endless output conveyor belt 4, which serves to carry away the nonwoven, produced from a fiber web 6, in a transport direction perpendicular to the plane of the drawing. The fiber web 6 is illustrated in broken line for the sake of clarity and is fed to an upper run 21 of a first web conveyor belt 20 in the direction of the arrow A.

Above the output conveyor belt 4, a laying carriage 10 is movable back and forth on rails or pipes (not shown). Five freely rotatable deflection rollers 11, 12, 13, 14, 15 are supported in the laying carriage 10. The first deflection roller 11 and the fifth deflection roller 15 are partially wrapped by the first web conveyor belt 20, wherein this belt is deflected in such a way that it leaves the laying carriage 10 above a third web conveyor belt 24. The fourth deflection roller 14 is partially wrapped by a second web conveyor belt 22, which runs between the upper carriage 30 and the laying carriage 10 very close to the first web conveyor belt 20; it is deflected by 180° around the fourth deflection roller 14 and is then led back, close to the output conveyor belt 4, over several stationary deflection rollers mounted in the machine stand, to the upper carriage 30. The deflection rollers 12 and 13 in the laying carriage 10 are partially wrapped by a third web conveyor belt 24, which also runs a short distance above the output conveyor belt 4 and returns by way of several stationary deflection rollers in the machine stand to the laying carriage 10. In the embodiment of a cross lapper shown here with three web conveyor belts, the second and third web conveyor belts 22, 24 reverse direction in a common tension carriage 80 in an area underneath the output conveyor belt 4. The person skilled in the art is familiar with many other embodiments of cross lappers with two or more web conveyor belts, which are adapted to the laying of nonwovens on an output conveyor belt 4 and in which the arrangement and guidance of the web conveyor belts and the arrangement and number of deflection rollers in the laying carriage 10 and in the machine stand are variable.

A chain or toothed belt, which runs over a pinion gear drive connected to a motor, and a deflection roller (these elements not shown) are mounted on the laying carriage 10. By means of these drive devices, the laying carriage 10 can be moved back and forth above the output conveyor belt 4 transversely to the conveying direction of the output conveyor belt 4.

At approximately the same height as the laying carriage 10, the upper carriage 30 is supported on rails or pipes (not shown) so that it can move transversely to the conveying direction of the output conveyor belt 4 in the machine stand of the cross lapper 2. The rails or pipes can be the same rails or pipes on which the laying carriage 10 is also movably supported. The upper carriage 30 has a deflection roller 32, around which the first web conveyor belt 20 is deflected so that it is then parallel to the second web conveyor belt 22 and can proceed toward the laying carriage 10.

Proceeding from the deflection roller 32 in the upper carriage 30, the first web conveyor belt 20 runs through the laying carriage 10 and from there is guided over several deflection rollers in the machine stand and a deflection roller mounted in a tension carriage 50, whereupon it runs over several stationary deflection rollers supported in the machine stand of the cross lapper 2 above the tension carriage 50 before it arrives back at the upper carriage 30. The upper carriage 30 and the tension carriage 50 can be connected to each other by a chain or a toothed belt (not shown), which runs over a pinion gear drive connected to a motor (not shown) and a deflection roller (not shown), which are supported in the machine stand. The tension carriage 50 is also movably supported on rails or pipes (not shown).

In the area between the deflection roller 32 of the upper carriage 30 and the deflection rollers 14 and 15 of the laying carriage 10, sections of the first web conveyor belt 20 and of the second web conveyor belt 22 are guided parallel to, and a very short distance away from, each other, so that a fiber web 6 supplied by the first web conveyor belt 20 is sandwiched between the first web conveyor belt 20 and the second web conveyor belt 22 in said area between the upper carriage 30 and the laying carriage 10. The fiber web 6 is supported by the second web conveyor belt 22. In addition, the two sections of the second web conveyor belt 22 extending between the laying carriage 10 and the machine stand of the cross lapper 2 simultaneously serve the function of a cover belt for the laid nonwoven.

It can be seen in FIG. 1 that, during operation, the upper carriage 30 and its associated tension carriage 50 move in opposite directions. The tension carriage 50 serves to keep the length of the loop of the first web conveyor belt 20 constant.

The movements of the laying carriage 10 and of the upper carriage 30 are coordinated with each other in such a way that, as the fiber web 6 is being fed at uniform speed to the cross lapper 2, the fiber web 6 can be laid in a controlled manner on the output conveyor belt 4 without being stretched or compressed inside the cross lapper 2. During this process, the upper carriage 30 always moves in the same direction as the laying carriage 10, but, on average, at only half its speed. Account is also taken of the fact that the laying carriage 10 must be braked almost to a stop and then accelerated again in the area of its reversal points. If the fiber web 6 is being fed at a fluctuating speed because, for example, a cyclically operating web drafter (not shown), which produces changes in the weight per unit area of the fiber web 6 for the purpose of creating a transverse profiling of the laid nonwoven, is installed upstream of the cross lapper 2, the movements of the upper carriage 30 and of the laying carriage 10 can be controlled independently of each other in the known manner to create a storage buffer for the fiber web inside the cross lapper 2.

Between the deflection rollers 13 and 14 in the laying carriage 10, a gap is formed, called the "laying nip". During the operation of the cross lapper 2, the two web conveyor belts 22, 24 are driven in such a way that they travel at the same speed. The fiber web 6 is guided through the laying nip and laid onto the output conveyor belt 4.

The cross lapper 2 in FIG. 1 comprises a cover belt 26, which comprises a cover section 40, which extends from the infeed area 8 of the cross lapper 2 to the upper carriage 30. The cover section 40 extends directly above the upper run 21 of the first web conveyor belt 20, which, in this area, serves as a support surface for the fiber web 6 and moves in the direction of the arrow A. The fiber web 6 is thus sandwiched between the upper run 21 of the first web conveyor belt 20 and the cover section 40 of the cover belt 26. Whereas the first web conveyor belt 20 is configured as a rough, preferably air-permeable, screen belt, the cover belt 26 is configured as a smooth belt, so that the fiber web 6 can slide along the bottom surface of the cover section 40. The cover belt 26 is preferably air-impermeable and is made of, for example, Teflon-coated or PVC-coated fabric. It is also possible for the first web conveyor belt 20 to be air-impermeable; for example, it could have a "diced" PVC surface, while the cover belt 26 is not rough but does have pores to allow air to escape. Other suitable material and design alternatives for the web conveyor belts are known to the person skilled in the art. In all cases the cover belt 26 must be prevented from interfering with the sliding movement of the fiber web 6 and fibers must be prevented from sticking to it. The second web conveyor belt 22 is preferably identical to the first web conveyor belt 20 in terms of its surface nature and material.

As a result of frictional forces, the endless first web conveyor belt 20 carries along the fiber web 6 resting on it, and the cover section 40 of the cover belt 26, which does not move along with the fiber web 6, serves as a cover and thus prevents the fiber web 6 from being blown about, which is undesirable. The fiber web 6 thus remains almost completely free of turbulence, as a result of which higher line speeds can be realized. In other words, the fiber web 6 is sandwiched between the upper run 21 of the first web conveyor belt 20 and the cover section 40 of the cover belt 26, wherein it is moved forward primarily by the movement of the first web conveyor belt 20, and the smooth cover belt 26 does not impede the movement of the fiber web 6.

In the upper carriage 30, the first end section 27 of the cover belt 26 is connected to the upper carriage 30 at an attachment point. As can be seen in FIG. 1, preferably at least one first fiber web guide means 60 is provided in the section between this attachment point of the first end section 27 of the cover belt 26 in the upper carriage 30 and the point at which the fiber web 6 is transferred to the second web conveyor belt 22. The guide means guides the fiber web 6 in this area, wherein the fiber web 6 is sandwiched between the first fiber web guide means 60 and the first web conveyor belt 20. The fiber web guide means 60 extends advantageously over the entire area between the attachment point of the cover belt 26 and the transfer point of the fiber web 6 to the second web conveyor belt 22 and is installed as closely as possible to the second web conveyor belt 22. The contour of the fiber web guide means 60 is adapted to the course taken by the first web conveyor belt 20 and the fiber web 6 around the deflection roller 32. Suitable fiber web guide means 60 are known to the person skilled in the art from, for example, EP 1 947 223 A1 and can vary with respect to shape and number as appropriate, as long as they ensure that the fiber web 6 is guided and covered reliably. It is in this case especially advantageous for the attachment point of the first end section 27 of the cover belt 26 in the upper carriage 30 to be located on the fiber web guide means 60, because, as a result, the fiber web 6 remains almost completely sandwiched until it reaches the laying carriage 10, i.e., enclosed first between the first web conveyor belt 20 and the cover section 40 of the cover belt 26, then between the first web conveyor belt 20 and the fiber web guide means 60, and finally between the first web conveyor belt 20 and the second web conveyor belt 22. As a result, the fiber web 6 is prevented from being blown about even at high line speeds and high accelerations of the upper carriage 30.

A compensating mechanism (not shown) serves to compensate for the changes in the length of the cover section 40 of the cover belt 26 which occur as the upper carriage 30 moves transversely back and forth.

In the preferred embodiment shown here, the cover belt 26 is conducted upward in the infeed area 8 of the cross lapper 2, away from the first web conveyor belt 20 and around the deflection roller 34, so that at least the second section 28 of the cover belt 26 is substantially parallel to the upper run 21 of the first web conveyor belt 20. If the cover belt 26 is also air-permeable, the deflection roller 34 can preferably be configured as a perforated roller.

In the embodiment according to FIG. 1, the compensating mechanism (not shown) is implemented by means of the tension carriage 50 of the first web conveyor belt 20. For this purpose, two tension brackets 52 are provided on the tension carriage 50. These tension brackets 52 are attached to the sides of the tension carriage 50 and project upward from it, beyond the upper run 21 of the first web conveyor belt 20. The two tension brackets 52 are connected to each other by a rail 54, which comprises an attachment point for the second end section 28 of the cover belt 26. This embodiment is especially compact and simple, because the movement of the tension carriage 50 is already ideally coupled with the movement of the upper carriage 30 in the opposite direction, and thus there is no need for any other moving machine parts or control systems.

It is obvious, however, that the person skilled in the art will be able to imagine other ways of implementing the compensating mechanism. For example, the second end section 28 of the cover belt 26 could be rolled up onto a supply roll and pulled back off again, or a separate tension carriage could be provided for the second end section 28. A simple hanging storage buffer for the cover belt 26 or some other type of buffer could also be imagined.

To prevent the fiber web 6 from being blown about as effectively as possible in the infeed area 8 as well, preferably a second fiber web guide means 70 is provided in the area extending from the infeed area 8 to a point at which the fiber web 6 is sandwiched between the first web conveyor belt 20 and the cover section 40 of the cover belt 26. The second fiber web guide means 70 guides the fiber web 6 in this section, wherein the fiber web 6 is thus sandwiched between the second fiber web guide means 70 and the first web conveyor belt 20 The second fiber web guide means 70 extends advantageously from the infeed area 8 of the cross lapper 2 to the deflection roller 34 of the web conveyor belt 26 and as closely as possible to that belt. When configuring the second fiber web guide means 70, the person skilled in the art can borrow ideas from the first fiber web guide means 60, wherein the contour of the second fiber web guide means 70 is to be adapted to the course of the first web conveyor belt 20. Additional suitable fiber web guide means 70 such as cover belt sections, for example, can also be used.

Figure 2:
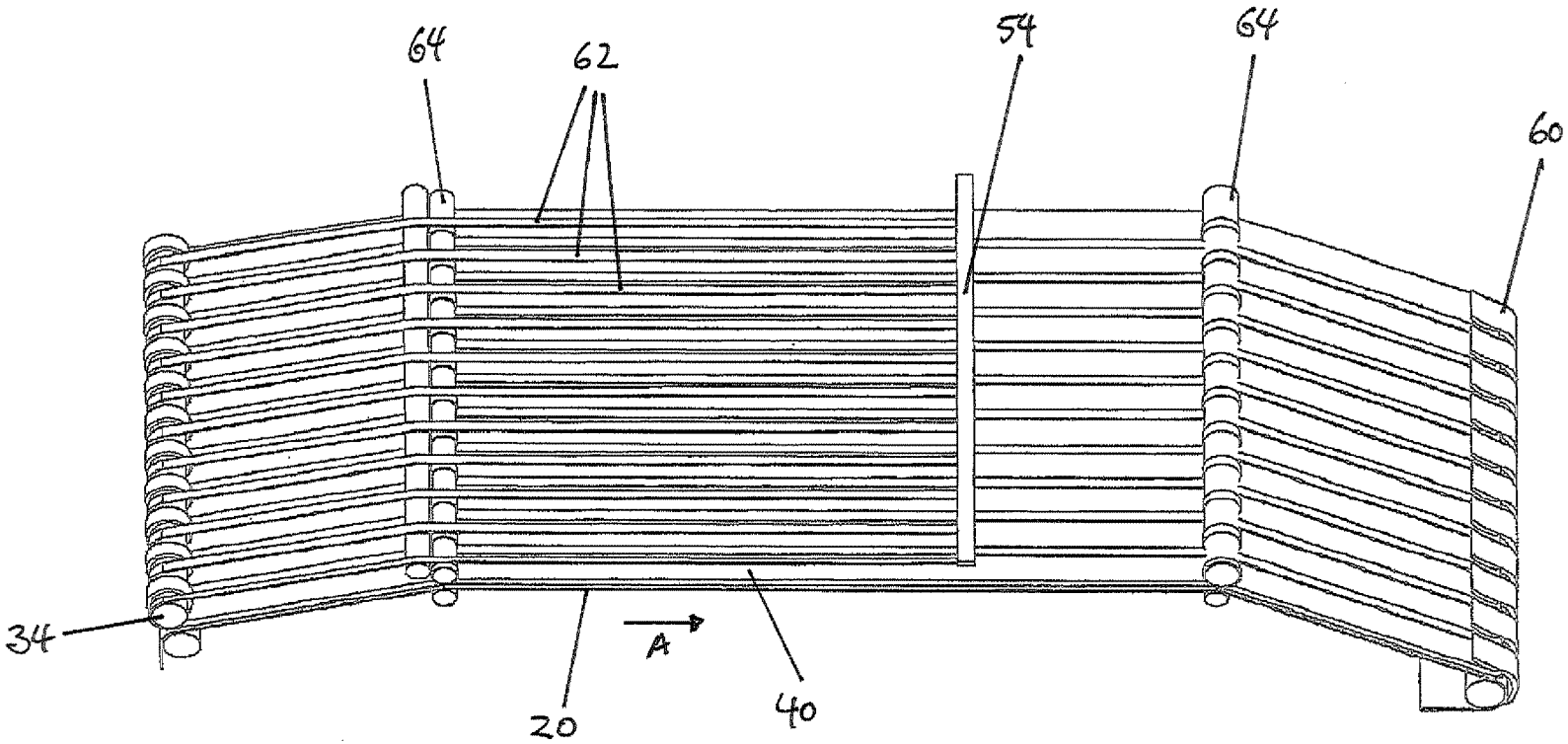
FIG. 2 shows a perspective schematic diagram of a possible arrangement of linear elements for covering the fiber web.

FIG. 2 shows an alternative embodiment of the fiber web cover. Here the cover section 40 is not realized as part of a cover belt 26 but rather by an array of linear elements 62. Otherwise, the configuration with linear elements 62 is substantially the same as that of the embodiment with a cover belt 26 shown in FIG. 1. For the sake of clarity, FIG. 2 shows only the details of the web covering, whereas the elements of the cross lapper identical to those of the embodiment of FIG. 1 have been omitted.

A first end section of the array of linear elements 62 in FIG. 2 is again attached to the tension carriage 50; in the concrete example shown here, it is attached to the rail 54. The deflection of the linear elements 2 is accomplished in a manner similar to the deflection of the cover belt 26 in FIG. 1. The deflection roller 34 can be configured as a multi-disk deflection roller. The second end section of the array of linear elements 62 is again attached to the upper carriage 30, preferably to the first fiber web guide means 60.

The linear elements 62 are arranged a certain distance above the first web conveyor belt 20. They are parallel to each other, extending in the transport direction A of the first web conveyor belt 20, and are arranged next to each other, transversely to the transport direction A, a certain distance apart. The linear elements 62 are preferably held under tension.

In the example shown here, the linear elements 62 are configured as narrow belts, which can be made of, for example, thin high-grade steel, plastic, Teflon, or coated textile material. Cords, yarns, stranded wires, or solid wires of these materials can also be used as linear elements 62. For example, teflonized wires, plastic-coated wires, or high-grade steel wires can be used. The linear elements 62 are preferably non-rigid. In all cases, the linear elements must have a smooth surface, so that the fiber web 6 being carried along on the first web conveyor belt 20 can easily slide along the bottom surface of the linear elements 62.

The width of the individual linear elements is preferably in the range of 1-5 mm. The distance between two linear elements 62 is preferably in the range of 2-50 mm, and especially in the range of 10-30 mm.

When linear elements 62 are used, the air carried along by the fiber web 6 can escape through the intermediate spaces between the individual linear elements 62. To this extent, the first web conveyor belt 20 does not necessarily have to be air-permeable.

In the example shown in FIG. 2, the linear elements 62 are wound in loops around deflection rollers 64 to prevent the linear elements 62 from applying too much pressure to the fiber web 6 at these points. The linear elements 62, however, could also be conducted in a straight line, without forming loops.

With the configuration of a cross lapper 2 according to the invention, it is possible with little structural effort to realize high line speeds without the risk of the fiber web 6 being blown about undesirably and without causing increased wear of the cover belt 26. In all cases, the frictional force between the fiber web 6 and the first web conveyor belt 20 is greater than the frictional force between the fiber web 6 and the cover (cover belt 26 or array of linear elements 62). The coefficient of friction between the fiber web 6 and the first web conveyor belt 20 is also preferably greater than the coefficient of friction between the fiber web 6 and the cover.

The distance between the cover and the first web conveyor belt 20 depends on the fiber web 6 to be conveyed and is usually in the range of 0.1-100 mm, and preferably in the range of 0.5-5 mm. The height of the cover is preferably adjustable.

The invention is also applicable to opposite-motion cross lappers, in which the upper carriage 30 and the laying carriage 10 move in opposite directions, and also to camel-back cross lappers.

A wide variety of materials are available for the various parts discussed and illustrated herein. While the principles of this device have been described in connection with specific embodiments, it should be understood clearly that these descriptions are made only by way of example and are not intended to limit the scope of the application.

The invention claimed is:

1. A cross lapper for forming a nonwoven fabric from a fiber web, the cross lapper including an output conveyor belt for movement of the nonwoven fabric in a first direction, the cross lapper comprising:

an upper carriage through which the fiber web is guided, the upper carriage being moveable transversely to the first direction;

a laying carriage through which the fiber web coming from the upper carriage is guided and which serves to lay the fiber web onto the output conveyor belt, the laying carriage being moveable transversely to the first direction;

at least first and second web conveyor belts to guide the fiber web to the upper carriage and onward to the laying carriage;

the first web conveyor belt having an upper run which extends from an infeed area to the upper carriage, is a support surface for the fiber web, and is configured as a rough fiber web conveyor belt which frictionally carries the fiber web;

a cover section above the upper run of the first web conveyor belt, the cover section covering a top surface of the fiber web, resting on the upper run, and being configured as a section of a cover belt, the cover belt being configured to be smooth, and the fiber web moving along a bottom surface of the cover section;

a first end section of the cover belt being connected to the upper carriage; and a compensating mechanism to compensate for changes in a length of the cover section occurring as the upper carriage moves.

2. The cross lapper according to claim 1 further including a tension carriage movable transversely back and forth in a direction opposite to the movement direction of the upper carriage, the tension carriage being a component of the compensating mechanism and a second end section of the cover belt is connected to the tension carriage.

3. The cross lapper according to claim 2 wherein the cover belt is deflected in the infeed area of the cross lapper and a second end section of the cover belt is guided parallel to the upper run of the first web conveyor belt up to an attachment point on the tension carriage and is fastened to the attachment point.

4. The cross lapper according to claim 3 wherein the attachment point is formed on a rail.

5. The cross lapper according to claim 4 wherein the tension carriage is arranged under the upper run of the first web conveyor belt and the rail is arranged between two tension brackets which are attached laterally to the tension carriage and project upward from the tension carriage beyond the upper run of the first web conveyor belt.

6. The cross lapper according to claim 1 wherein in a section between the attachment point of the first end section of the cover belt on the upper carriage and a point where the fiber web is transferred to the second web conveyor belt, at least one first fiber web guide means is provided, which guides the fiber web in said section and the fiber web is sandwiched between the at least one first fiber web guide means and the first web conveyor belt.

7. The cross lapper according to claim 6 wherein the attachment point of the first end section of the cover belt in the upper carriage is arranged on, and fastened to, the first fiber web guide means.

8. The cross lapper according to claim 1 wherein in a section of the infeed area extending up to a point at which the fiber web is sandwiched between the first web conveyor belt and the cover section, at least one second fiber web guide means is provided which guides the fiber web in said section and the fiber web is sandwiched between the at least one second fiber web guide means and the first web conveyor belt.

9. The cross lapper according to claim 1 wherein the cover belt is air-permeable.

10. The cross lapper according to claim 1 wherein the cover belt is air-impermeable.

11. The cross lapper according to claim 9 wherein the cover belt is a fabric belt coated with polytetrafluoroethylene or polyvinylchloride.

12. The cross lapper according to claim 10 wherein the first web conveyor belt is air-permeable.

13. A cross lapper for forming a nonwoven fabric from a fiber web, the cross lapper including an output conveyor belt for movement of the nonwoven fabric in a first direction, the cross lapper comprising:

an upper carriage through which the fiber web is guided, the upper carriage being moveable transversely to the first direction;

a laying carriage through which the fiber web coming from the upper carriage is guided and which serves to lay the fiber web onto the output conveyor belt, the laying carriage being moveable transversely to the first direction;

at least first and second web conveyor belts to guide the fiber web to the upper carriage and onward to the laying carriage;

the first web conveyor belt having an upper run which extends from an infeed area to the upper carriage, is a support surface for the fiber web, and is configured as a rough fiber web conveyor belt which frictionally carries the fiber web;

a cover section above the upper run of the first web conveyor belt, the cover section covering a top surface of the fiber web, resting on the upper run, and being configured as a section of an array of linear elements spaced apart and parallel to each other, the array of linear elements being configured to be smooth, and the fiber web moving along a bottom surface of the cover section;

a first end section of the array of linear elements being connected to the upper carriage; and a compensating mechanism to compensate for changes in a length of the cover section occurring as the upper carriage moves.

14. The cross lapper according to claim 13 further including a tension carriage movable transversely back and forth in a direction opposite to the movement direction of the upper carriage, the tension carriage being a component of the compensating mechanism and a second end section of the array of linear elements connected to the tension carriage.

15. The cross lapper according to claim 14 wherein the array of linear elements is deflected in the infeed area of the cross lapper and a second end section of the array of linear elements is guided parallel to the upper run of the first web conveyor belt up to an attachment point on the tension carriage and is fastened to the attachment point.

16. The cross lapper according to claim 15 wherein the attachment point is formed on a rail.

17. The cross lapper according to claim 16 wherein the tension carriage is arranged under the upper run of the first web conveyor belt and the rail is arranged between two tension brackets which are attached laterally to the tension carriage and project upward from the tension carriage beyond the upper run of the first web conveyor belt.

18. The cross lapper according to claim 13 wherein in a section between the attachment point of the first end section of the array of linear elements on the upper carriage and a point where the fiber web is transferred to the second web conveyor belt, at least one first fiber web guide means is provided, which guides the fiber web in said section and the fiber web is sandwiched between the at least one first fiber web guide means and the first web conveyor belt.

19. The cross lapper according to claim 18 wherein the attachment point of the first end section of the array of linear elements in the upper carriage is arranged on, and fastened to, the first fiber web guide means.

20. The cross lapper according to claim 13 wherein in a section of the infeed area extending up to a point at which the fiber web is sandwiched between the first web conveyor belt and the cover section, at least one second fiber web guide means is provided which guides the fiber web in said section and the fiber web is sandwiched between the at least one second fiber web guide means and the first web conveyor belt.

21. The cross lapper according to claim 13 wherein the linear elements are configured as cords, yarns, stranded wires or solid wires.

22. The cross lapper according to claim 13 wherein the linear elements are narrow belts.

* * * * *